US005988383A

United States Patent [19]

Armstrong

[11] Patent Number: 5,988,383

[45] **Date of Patent: *Nov. 23, 1999**

[54] LADDER SADDLE

[76] Inventor: Robert John Armstrong, 27255 Bagley Rd., Olmstead Township, Ohio 44138

[ * ] Notice: This patent issued on a continued prosecution application filed under 37 CFR 1.53(d), and is subject to the twenty year patent term provisions of 35 U.S.C. 154(a)(2).

[21] Appl. No.: 08/885,020

[22] Filed: Jun. 30, 1997

[51] Int. Cl.[6] ..... B65D 85/00

[52] U.S. Cl. ..... 206/373; 182/129

[58] Field of Search ..... 206/372, 373; 182/107, 129; 248/97, 238, 210

[56] References Cited

U.S. PATENT DOCUMENTS 4,356,854 11/1982 McGee .
4,726,446 2/1988 Perbix .
5,603,405 2/1997 Smith .
5,638,915 6/1997 Hardy .
5,639,003 6/1997 Utzinger, III .
5,647,453 7/1997 Cassells .

*Primary Examiner*—Jacob K. Ackun
*Attorney, Agent, or Firm*—Christopher J. Whewell

[57] ABSTRACT

A device for containing various work implements designed for use by workers who regularly use ladders. The device holds the implements in such fashion as to be ergonomically accessible while maintaining a reduced center of gravity and hence increased stability of the ladder/device combination as a whole. Use of this device increases safety and is cost-effective enough in its construction to be readily employed by workers in various arts.

20 Claims, 6 Drawing Sheets

LADDER SADDLE

BACKGROUND OF THE INVENTION

This invention relates to a holder of implements for individuals whose work performance regularly requires them to be located at the upper extremities of ladders, and is directed at a convenient means for organizing and containing various work implements.

BACKGROUND INFORMATION

Ladders have been employed since their inception to provide a means by which a worker may be placed into a position which is in closes proximity to an article needing physical manipulation or an elevated area needing work such as painting, plumbing, etc. There are several styles of ladders available, as this field of art is well-established. The general types of ladders available include: fixed ladders which are comprised of merely two rigid beams which are joined together by a plurality of rungs, and sliding ladders which are comprised of a combination of two fixed ladders. The two fixed ladders are oriented parallel to one another and are joined by simple hardwares which allow the sliding of the ladders with respect with one another. By such an arrangement, adjustment of the overall length of the combination is possible. The third type of ladder is the step-ladder. This consists of a fixed ladder which is joined to a supporting member having dimensions and construction similar to that of the fixed ladder portion but is designed primarily as a support. The supporting member and fixed ladder are oriented in a parallel configuration and are joined by means of a suitable hinge such that the ladder portion and support portion may be opened with respect to one another to form an essentially A-frame configuration which provides the ability to elevate ones-self in the absence of a fence, wall or other structure normally required when using a fixed ladder alone. It is to users of the step-ladder which the present invention is directed, but the instant invention is also anticipated as being useful on the other types of ladders as well, and it would be unnecessarily restrictive to view this specification and the appended claims as being delimitive in any way thereto.

One of the problems individuals who find themselves on ladders regularly encounter is that they must prevent themselves from falling from the ladder while performing the task at hand. Additionally, a variety of hand-implements are often required to carry out a task to its completion. From a statistical standpoint, the probability of an individual having a mishap varies directly as the number of times an individual goes up and down from the ladder in connection with a job. Therefore, if it were possible to minimize the number of up-and-down trips an individual were required to make in the normal course of carrying out ones duties, then the probability of a mishap could be accordingly minimized.

One way to minimize the number of up-and-down trips required to carry out a task is to provide every tool needed for a given job in close proximity to the location atop the ladder where the worker is situated. However, while the prior art contains many different types of devices aimed at this end, none has been successful in design to be ergonomically enjoyable, or cost-effective enough in manufacture to be commercially favorable for widespread adoption in industry.

Exemplary of the art in which the problems which the present invention are contained are described in U.S. Pat. No. 5,603,405 to Smith; U.S. Pat. No. 5,547,080 to Klimas; U.S. Pat. No. 5,505,302 to Ferley; U.S. Pat. No. 5,419,409 to Corulla; U.S. Pat. No. 4,730,802 to Chatham et al.; U.S. Pat. No. 4,550,803 to Finster et al.; and U.S. Pat. No. 4,261,435 to Winter. It is indeed unfortunate that all prior art to which the instant invention relates has been highly specialized, requiring such specialized tooling that the cost has prohibited widespread market acceptance. Additionally, the high degree of specialization of each prior art device limited the useful audience to a select few laddermen within one type of trade, for example, carpenters. The prior art devices are also cumbersome in their use and awkward to store when not in use.

It would be preferable for a ladder tool caddy to be inexpensive in manufacture, useful by a variety of tradesmen, and easy to use and store.

SUMMARY OF THE INVENTION

In accordance with the shortcomings contained in the prior art, it is an object of this invention to provide a convenient device through the use of which laddermen may minimize the number of up-and-down trips required them on a given task.

It is an object of this invention to provide a means for caddying tools used by laddermen.

It is a further object of this invention to provide a means for caddying tools used by laddermen which is ergonomically enjoyable.

It is a further object of this invention to provide a means for caddying tools used by laddermen which is cost-effective enough in its manufacture to gain wide acceptance by industry.

Finally, it is yet another object of this invention to provide a means for caddying tools used by laddermen which is useful by tradesmen in all fields.

As an added advantage, the instant invention eliminates the need for the workman to carry heavy tools on his belt which might otherwise tend to contribute to a situation of imbalance, which could catalyze a mishap.

The objects of this invention are achieved by providing a novel fabric hood which is affixable to the top portion of the step-ladder. The uppermost two rungs, (including the top rung) and the frame members of the ladder join together so as to form the framework of an essentially trapezoidal-solid volume at the top of the step-ladder. The hood of this invention is shaped so that it encloses this trapezoidal-solid volume. The hood of this invention also comprised pocket portions on its surfaces in which various tools and other implements such as screws, solder, nails, hammers, saws, wrenches, etc. may be securely housed.

An unexpected advantage of this invention is that the hood contributes to the structural strength of the ladder and provides increased traction for the topmost step.

A further unexpected advantage of this invention is that the center of gravity of the ladder to which the instant device is attached is reduced by virtue of the locations of the tools and implements held being lower than those analogous locations described in all prior art devices. This results in increased stability heretofore unseen in the art to which this invention pertains, and represents a major advance in safety.

DESCRIPTION OF THE DRAWINGS

The reader of this specification will appreciate pictorial representation of a device according hereto, and is referred to the drawings in which.

DETAILED DESCRIPTION OF THE INVENTION

This invention provides an article of manufacture which increases the safety and easiness by which persons working atop ladders may access tools and implements while working at elevated heights.

In its most preferred form, the device of this invention is a hood-like fabrication of woven fiber stock. It is contoured so as to snugly wrap around the upper portion of an ordinary step ladder when the ladder is in its normally opened position used when the ladder is in service. The hood is shown affixed to a conventional step-ladder in the various drawings, in its most preferred form, in position and ready for use. The hood is secured to the ladder by suitable fastening means and contains several pocket means and other convenient provisions for containing and securing the various tools and implements which may include: hammers, pliers, nails, solder, pipe lengths, adhesives, saws, drills, etc.

The pocket means are preferably constructed of the same fabric stock as the hood itself, although this is not necessary for the invention to act in its intended function. Preferably though the pocket means and the fabric of the hood are the same material, with woven nylon being the most preferred material. Other fabric stocks are contemplated as being useful for construction of the instant device, which include: woven cotton, woven nylon, woven rayon, woven polymers, woven polyester, kevlar(TM), nomex(TM), etc. Virtually any fabric material will suffice, provided it has the tensile strength to withstand the gravitational forces it normally encounters when loaded with the various tools without physically yielding and thus compromising the intended function.

Figure 1:
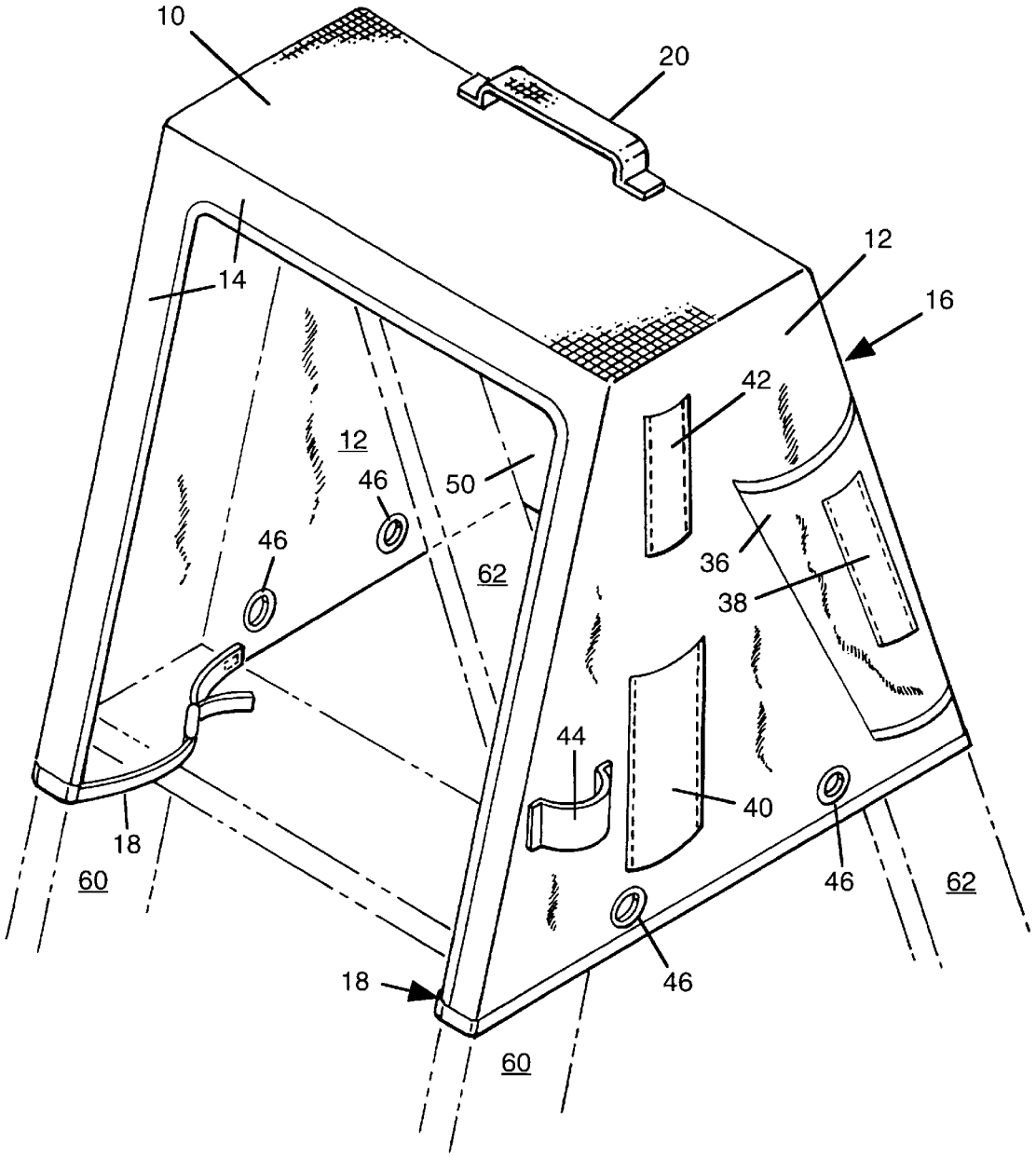
FIG. 1 represents a perspective view of the device of this invention attached to a conventional step-ladder.
Figure 2:
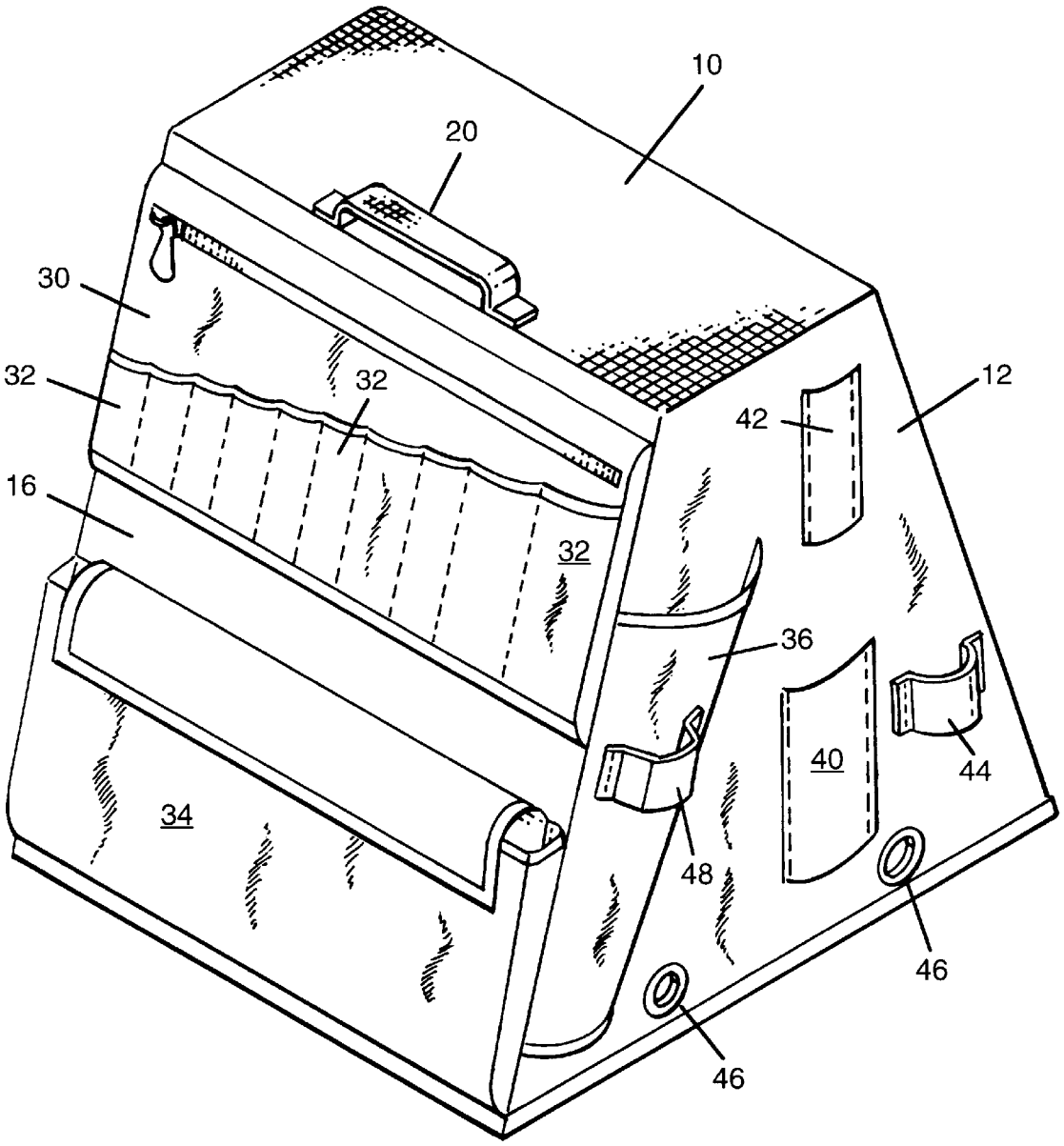
FIG. 2 is a perspective view showing the rear, left side and top portions of the instant device.
Figure 3:
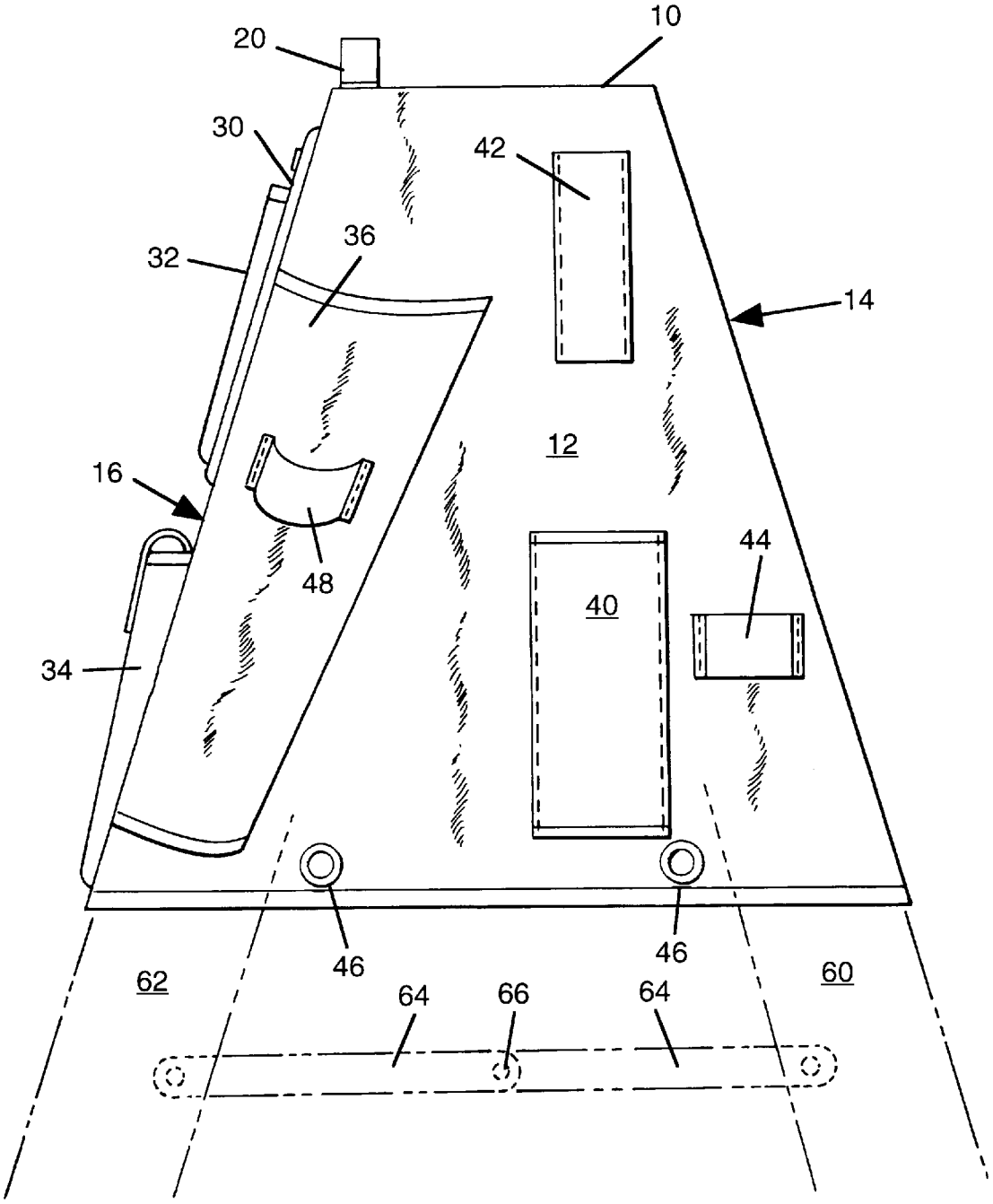
FIG. 3 shows the left side elevational view of a step-ladder to which a hood in accordance with this invention is affixed.
Figure 4:
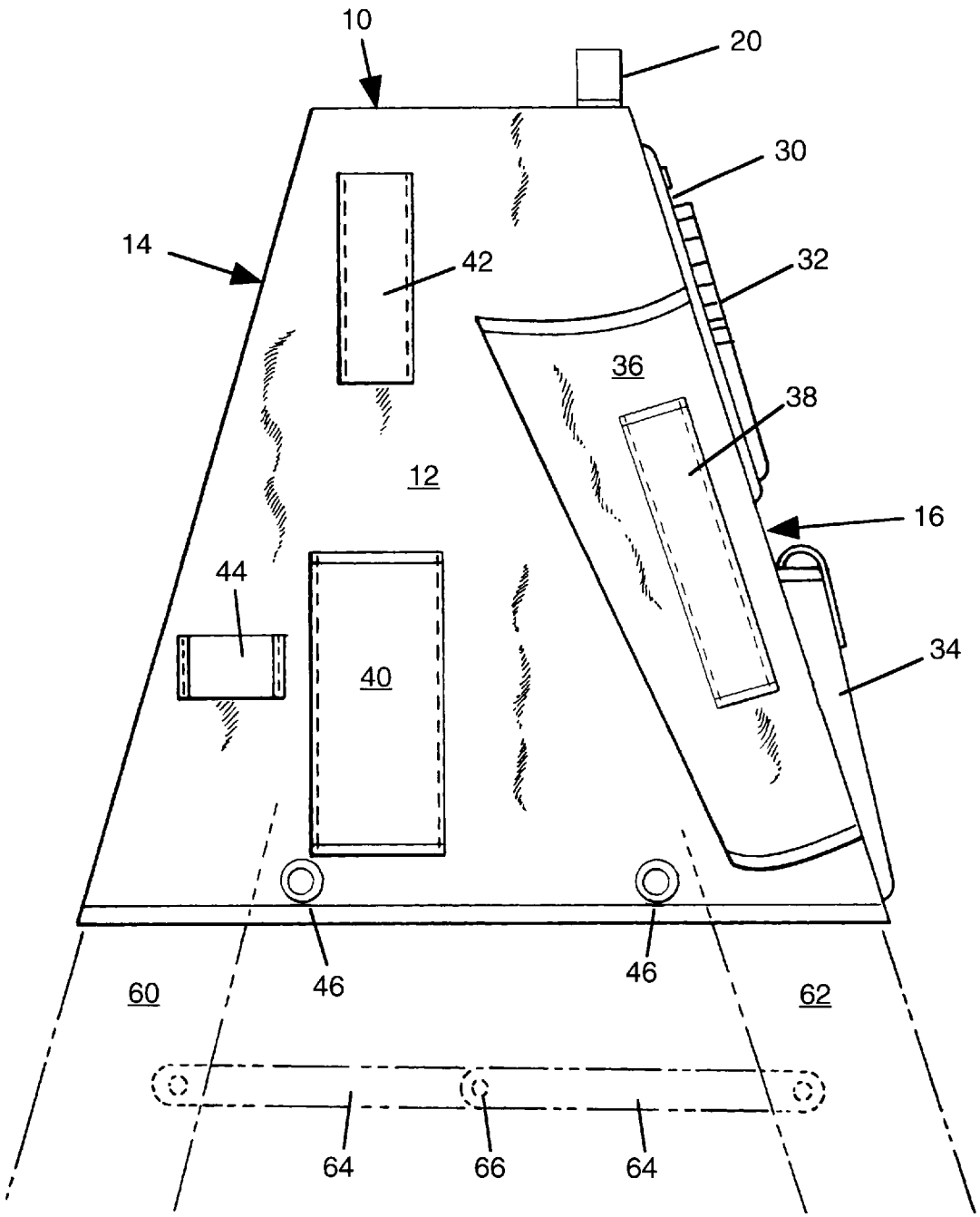
FIG. 4 shows the right side elevational view of a step-ladder to which a hood in accordance with this invention is affixed.
Figure 5:
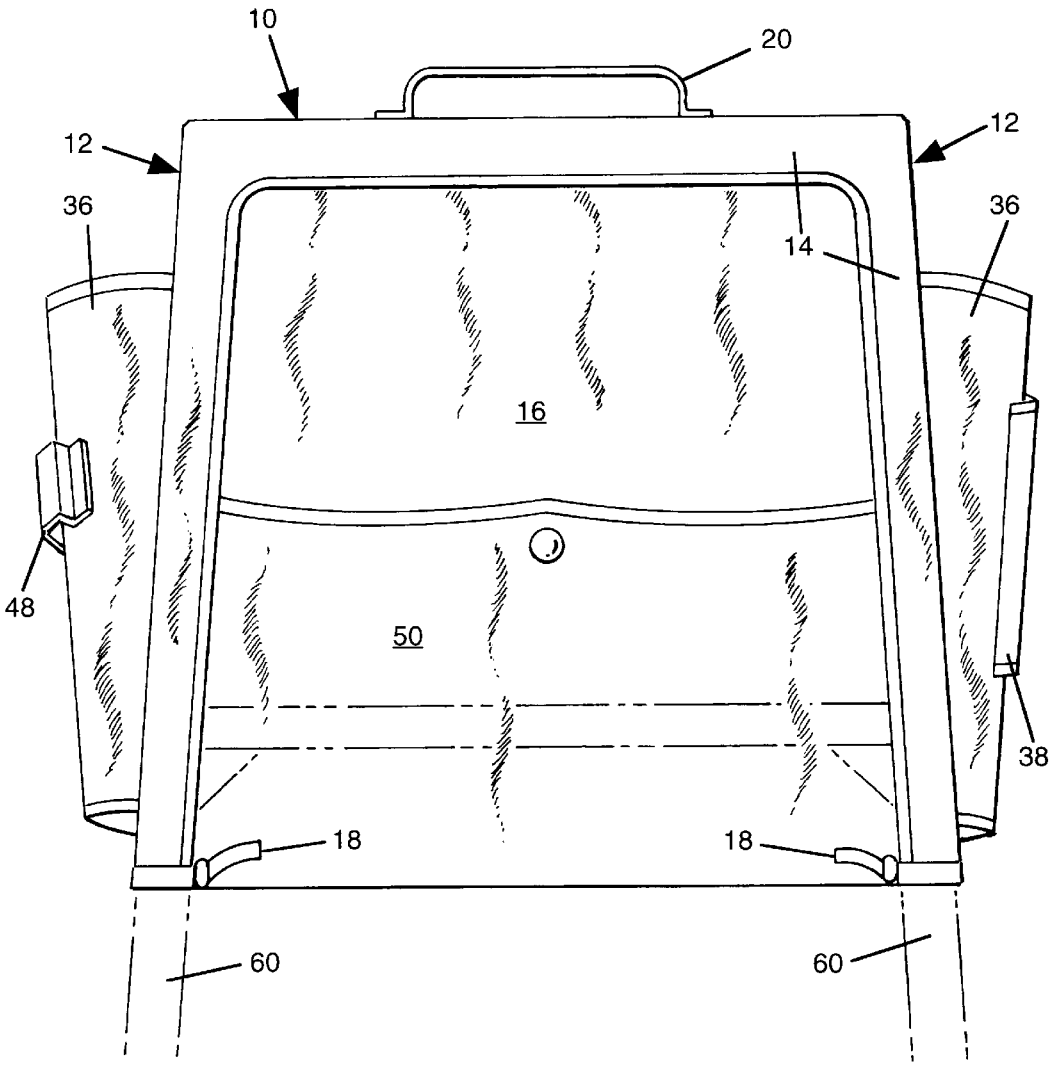
FIG. 5 shows the front elevational view of a step-ladder to which a hood in accordance with this invention is affixed.
Figure 6:
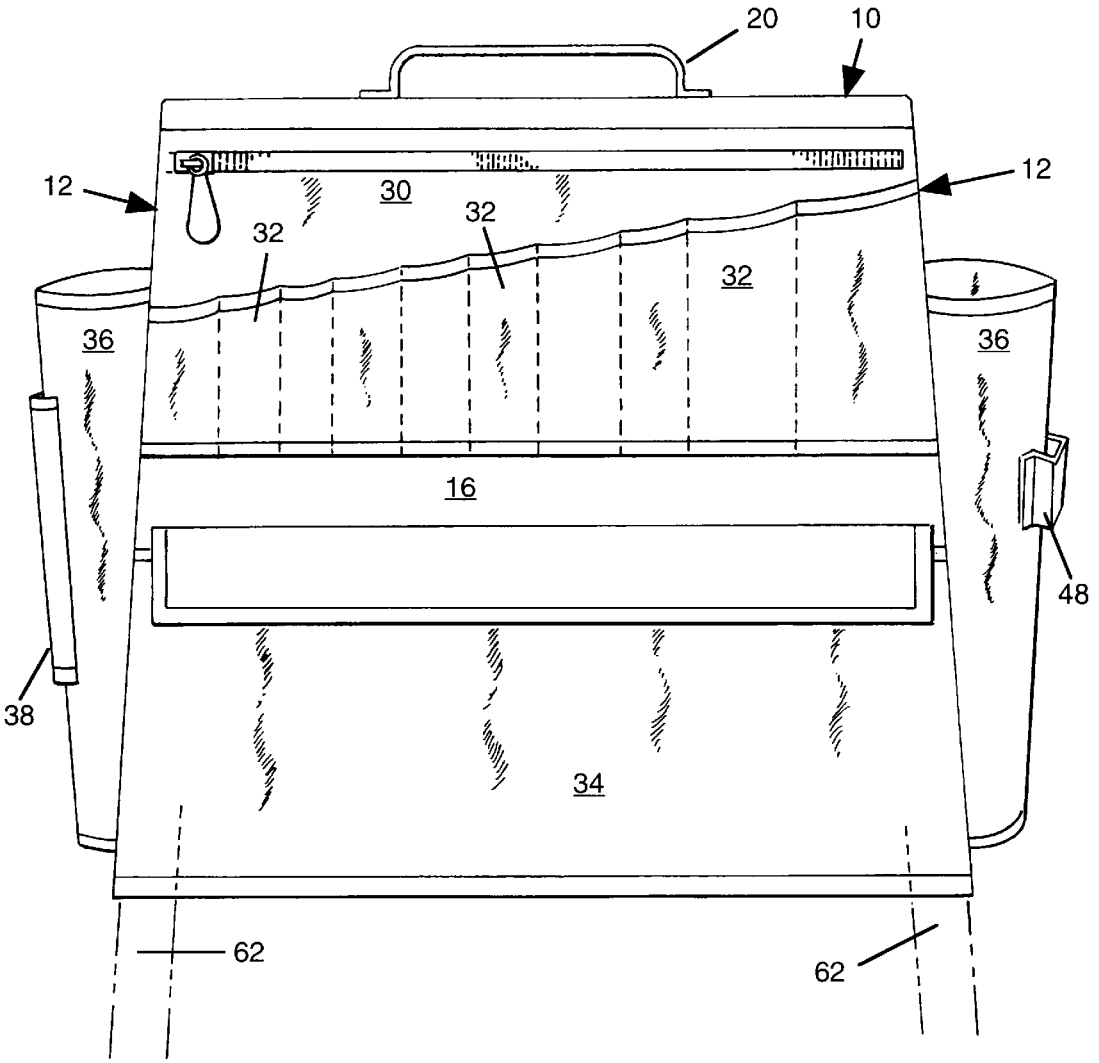
FIG. 6 shows the rear elevational view of a step-ladder to which a hood in accordance with this invention is affixed.

Referring to FIG. 1, 10 refers to the top portion of the hood which is a non-skid surface and may include various non-skid polymeric treatments well known to those skilled in the art of applying non-skid treatments to surfaces. This function is also synergistic insomuch as the non-skid treatment is preferably a waterproof polymeric coating such as a polyurethane coating and it tends to keep moisture from rain from penetrating into the fibers of the rest of the hood. The side panels 12 form an integral portion of the hood and are attached to the top 10 and step-side panels 14 and front panel 16 by stitching.

The hood of this invention is attached to the conventional step-ladder by fastening means 18 which preferably are straps but may also comprise cords or other equivalent means. There is affixed a handle 20 at the top of the hood which assists in removal of the device of this invention from the ladder at the appropriate time. The step-side ladder uprights 60, front ladder uprights 62, folding ladder brace 64 and ladder brace hinge 66 are shown for clarity.

As heretofore mentioned, there are attached to the instant device various means for holding the several implements or tools which are to be used by the workman. These include: a zipper slash pocket 30, several variable-size open slash pockets 32, a large bellows-type pocket 34, a plurality of tapered slash pockets 36 attached to the side of the instant device, the slash pockets 38, 40, and 42, loop-type holders 44 and 48, a plurality of grommets 46 located within the fabric itself which may accommodate s-hooks, and a zippered document pocket 50 suitable for containing blueprints.

In order to use the device of this invention, one begins by placing the step ladder in an open position. Next, the hood is placed over the top portion of the ladder (the apex) so as to effectively enclose an essentially trapezoidal-solid volume inherently formed by virtue of the ladder's constructional dimensions. For purposes of this invention, the apex portion is defined as the uppermost portion of a step-ladder, including all support members, braces, etc which are located above the three topmost steps of said ladder. The hood is then secured by tightening the fastening means 18. The workman next places the desired tools, implements, documents or the like in the desired positions provided for by the various pocket means, holder means, grommets, etc. Once the tools are in place, the workman ascends the ladder and begins his duties, having close at hand all the necessary tools required to carry out the specific task at hand. The various implements, once in place, may be left in their respective positions and the hood removed from the ladder at the end of the job by first loosening the fastening means and lifting on the handle 20. Conveniently, the whole may be replaced upon the ladder at a later time for continued work, or at the beginning of a new job.

Consideration must be given to the fact that while this invention has been described and disclosed in relation to certain preferred embodiments, obvious equivalent modifications and alterations thereof will become apparent to one of ordinary skill in this art after reading and understanding the contents of the specification herein. Accordingly, the presently disclosed invention is intended to cover all such modifications and alterations, and is limited only by the scope of the claims which now follow.

I claim:

1. A device useful for conveniently containing various work implements for use with a step ladder which comprises:

a) a rectangular top portion;

b) a trapezoidally-shaped first side panel connected to said top portion;

c) a trapezoidally-shaped second side panel connected to said top portion in a position opposite to that of said first side panel with respect to said rectangular top portion;

d) a step-side panel connected to said top portion; and e) a front panel connected to said top portion, wherein said front panel is connected to each of said side panels by stitchig.

2. The device as set forth in claim 1 further comprising a means for adjusting the tightness of at least one of said panels about the structural members of a step ladder.

3. The device as defined in claim 1 further comprising at least one pocket means.

4. The device as defined in claim 3 wherein said pocket means is open on at least one end.

5. The device as defined in claim 3 wherein said pocket means is sealable by means of a hook-and-loop type fastener.

6. The device as defined in claim 3 wherein said pocket means is sealable by means of a zipper.

7. The device as defined in claim 3 wherein said pocket means is sealable by means of a conventional fastener selected from the group consisting of: a button and hole, a snap fastener, and a rivet.

8. A combination designed to caddy various implements for those performing utility work while in elevated locations comprising:

a) a conventional step-ladder;

b) a durable fabric device which comprises:

i) a rectangular top portion capable of being positioned over the top platform of the ladder;

ii) a trapezoidally-shaped first side panel connected to said top portion;

iii) a trapezoidally-shaped second side panel connected to said top portion in a position opposite to that of said first side panel with respect to said rectangular top portion;

iv) a step-side panel connected to said top portion; and v) a front panel connected to said top portion wherein said front panel is connected to each of said side panels by stitching;

c) a zipper means as an integral part of said device disposed longitudinally on at least one of the faces of the solid trapezoid inherently defined by the device; and d) at least one means for containing implements which is attached to the outside of said device.

9. The combination as set forth in claim 8 wherein said means for containing implements includes at least one pocket means affixed to at least one of said side panels or front panel.

10. The combination as defined in claim 9 wherein said pocket means is open at least one end.

11. The device as defined in claim 9 wherein said pocket means is sealable by means of a hook-and-loop type fastener.

12. The device as defined in claim 9 wherein said pocket means is sealable by means of a zipper.

13. The device according to claim 1 wherein said front panels and said side panels are connected by stitching.

14. A device according to claim 13 wherein said top portion includes a non-skid polymeric surface treatment.

15. A device according to claim 13 wherein said top portion includes a handle portion.

16. A device according to claim 13 further comprising a fastening means for adjusting the tightness of the fabric sheath about the structural members of said step ladder.

17. A device according to claim 16 further comprising at least one pocket means.

18. A device according to claim 13 wherein at least one of said side panels is attached to said front panel by means of stitching.

19. A device according to claim 13 further comprising a zipper means as an integral part of said device disposed longitudinally on at least one of the faces of the solid trapezoid defined by the device.

20. A device according to claim 17 wherein said pocket means is sealable by means of a hook-and-loop type fastener.

* * * * *